US010962908B2

(12) United States Patent
Yamaguchi et al.

(10) Patent No.: US 10,962,908 B2
(45) Date of Patent: Mar. 30, 2021

(54) HEATING DEVICE, FIXING DEVICE, AND IMAGE FORMING APPARATUS

(71) Applicants: Yoshiki Yamaguchi, Kanagawa (JP); Ippei Fujimoto, Kanagawa (JP)

(72) Inventors: Yoshiki Yamaguchi, Kanagawa (JP); Ippei Fujimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/848,212

(22) Filed: Apr. 14, 2020

(65) Prior Publication Data

US 2020/0387094 A1 Dec. 10, 2020

(30) Foreign Application Priority Data

Jun. 5, 2019 (JP) ..... JP2019-105117

(51) Int. Cl.
*G03G 15/20* (2006.01)

(52) U.S. Cl.
CPC ..... *G03G 15/2025* (2013.01); *G03G 15/2053* (2013.01)

(58) Field of Classification Search
CPC ..... G03G 15/2025; G03G 15/2053; G03G 2215/2016; G03G 2215/2035
See application file for complete search history.

(56) References Cited

U.S. PATENT DOCUMENTS

2013/0034374 A1* 2/2013 Ohtsu ..... G03G 15/2053 399/329
2014/0205332 A1* 7/2014 Otsu ..... G03G 15/2053 399/329
2017/0176906 A1 6/2017 Sawada et al.
2017/0176907 A1 6/2017 Sawada et al.
2018/0335733 A1 11/2018 Matsuda et al.
2020/0033777 A1 1/2020 Fujimoto et al.

FOREIGN PATENT DOCUMENTS

JP 9-101695 4/1997
JP 2004-206105 7/2004
JP 2005-091557 4/2005
JP 2014-145840 8/2014
JP 2017-125922 7/2017
JP 2018-072551 5/2018

OTHER PUBLICATIONS

U.S. Appl. No. 16/811,955, filed Mar. 6, 2020, Yoshiharu Takahashi, et al.

* cited by examiner

*Primary Examiner* — Sandra Brase
(74) *Attorney, Agent, or Firm* — Oblon, McClelland, Maier & Neustadt, L.L.P.

(57) ABSTRACT

A heating device includes a first rotator, a heater, a second rotator to contact an outer surface of the first rotator, a nip formation pad inside a loop of the first rotator to form a nip, a thermal equalizer to cover a surface of the nip formation pad opposite the first rotator and transport heat in an axial direction of the first rotator, and a lubricant disposed between the thermal equalizer and the first rotator. The thermal equalizer has a plurality of concave portions on a surface opposite the inner surface of the first rotator. The concave portion has a shape substantially symmetrical with respect to a first center line extending in a longitudinal direction of the thermal equalizer and a second center line in a cross section of the concave portion viewed from a direction perpendicular to a direction of movement of the first rotator.

13 Claims, 8 Drawing Sheets

B: DIRECTION OF MOVEMENT OF FIXING BELT

HEATING DEVICE, FIXING DEVICE, AND IMAGE FORMING APPARATUS

CROSS-REFERENCE TO RELATED APPLICATION

This patent application is based on and claims priority pursuant to 35 U.S.C. § 119 to Japanese Patent Application No. 2019-105117, filed on Jun. 5, 2019 in the Japan Patent Office, the entire disclosure of which is hereby incorporated by reference herein.

BACKGROUND

Technical Field

Embodiments of the present disclosure generally relate to a heating device, a fixing device, and an image forming apparatus. In particular, the embodiments of the present disclosure relate to a heating device, a fixing device with the heating device for fixing a toner image on a recording medium, and an image forming apparatus with the fixing device for forming an image on a recording medium.

Background Art

In image forming apparatuses, a fixing device is an example of a heating device that includes a thin, film-like endless belt having a low thermal capacity and a heat source that directly heats the endless belt to fix an image and can achieve a desired fixing property even if the fixing device is installed in high speed image forming apparatuses.

In such a fixing device, a rotator disposed on the outer peripheral surface of the endless fixing belt presses against a supporter as a nip formation member fixed inside the loop formed by the fixing belt via the fixing belt to form a fixing nip. Additionally, setting a thermal equalizer made of metal having high thermal conductivity on the nip formation member can equalize the temperature on the fixing belt and reduce a temperature rise at an end portion of the fixing belt when the fixing device operates continuously, fixing images on small sheets passing through the nip.

Such a fixing device includes a friction-reducing sheet made of fiber such as polytetrafluoroethylene (PTFE) impregnated with lubricant such as silicone grease to reduce sliding resistance (torque) between the fixing belt and the nip formation member on a surface of the nip formation member. However, the friction-reducing sheet itself is a heat insulator and may prevent temperatures on the fixing belt from being uniform.

Therefore, instead of the friction-reducing sheet, a configuration is proposed in which a coating layer having good slidability is directly coated on a surface of the thermal equalizer, and a surface of the coating layer is processed to have a surface roughness suitable for holding the grease.

SUMMARY

This specification describes an improved heating device that includes a first rotator forming a loop, a heater configured to heat the first rotator, a second rotator configured to contact an outer circumferential surface of the first rotator, a nip formation pad disposed inside the loop of the first rotator to form a nip between the first rotator and the second rotator, a thermal equalizer configured to cover a surface of the nip formation pad opposite the first rotator and transport heat in an axial direction of the first rotator, and a lubricant disposed between the thermal equalizer and the inner circumferential surface of the first rotator. The thermal equalizer has a plurality of concave portions on a surface opposite the inner circumferential surface of the first rotator. Each of the concave portions has a shape substantially symmetrical with respect to a first center line extending in a longitudinal direction of the thermal equalizer and a second center line in a cross section of the thermal equalizer viewed from a direction perpendicular to a direction of movement of the first rotator.

This specification further describes an improved heating device that includes a first rotator forming a loop, a heater configured to heat the first rotator, a second rotator configured to contact an outer circumferential surface of the first rotator, a nip formation pad disposed inside the loop of the first rotator to form a nip between the first rotator and the second rotator, a thermal equalizer configured to cover a surface of the nip formation pad opposite the first rotator and transport heat in an axial direction of the first rotator, and a lubricant disposed between the thermal equalizer and the inner circumferential surface of the first rotator. The thermal equalizer has a plurality of concave portions on a surface opposite the inner circumferential surface of the first rotator. Each of the concave portions has a shape substantially symmetrical with respect to two center lines orthogonal to each other on the surface of the thermal equalizer and center lines in cross sections of the concave portion viewed from directions of the two center lines.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
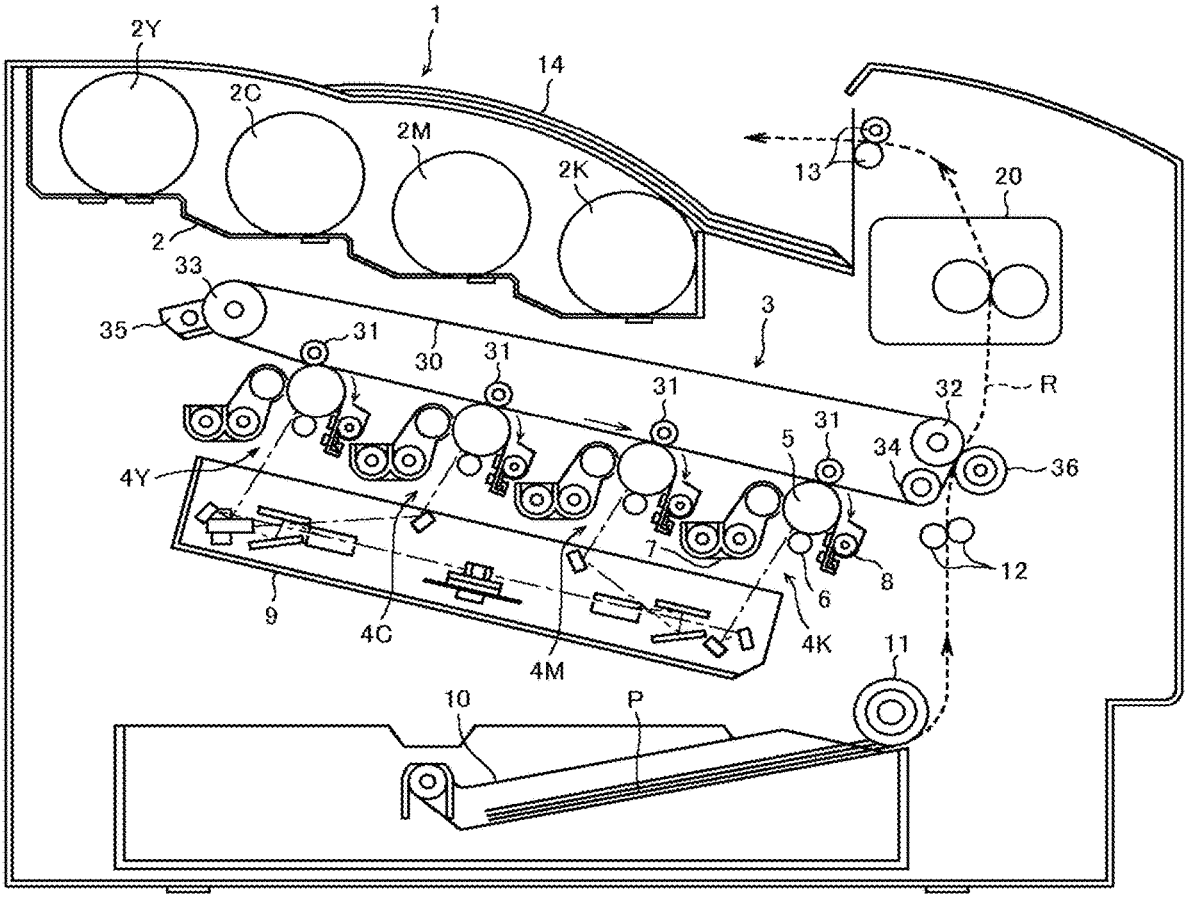
FIG. 1 is a schematic diagram illustrating an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and all of the components or elements described in the embodiments of this disclosure are not necessarily indispensable.

FIG. 1 is a schematic diagram illustrating an overall configuration of an image forming apparatus according to an embodiment of the present disclosure.

In the present embodiment, the image forming apparatus 1 is a color laser printer including four image forming devices 4Y, 4C, 4M, and 4K situated in a center portion of the image forming apparatus 1. The image forming devices 4Y, 4C, 4M, and 4K are aligned in a stretch direction in which an intermediate transfer belt 30 is stretched. Although the image forming devices 4Y, 4C, 4M, and 4K contain developers in different colors, that is, yellow, cyan, magenta, and black corresponding to color separation components of a color image (e.g., yellow, cyan, magenta, and black toners), respectively, the image forming devices 4Y, 4C, 4M, and 4K have an identical structure.

Specifically, each of the image forming devices 4Y, 4C, 4M, and 4K is an image station that includes a drum-shaped photoconductor 5 as a latent image bearer, a charger 6 to charge a surface of the photoconductor 5, a developing device 7 that supplies toner to an electrostatic latent image formed on the surface of the photoconductor 5, and a cleaner 8 that cleans the surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4C, and 4M that form yellow, cyan, and magenta toner images, respectively, are omitted for convenience.

An exposure device 9 is disposed below the image forming devices 4Y, 4M, 4C, and 4K and exposes the outer circumferential surfaces of the respective photoconductors 5 with laser beams. The exposure device 9 includes a light source, a polygon mirror, an f-θ lens, and a reflection mirror to irradiate the surface of the photoconductor 5 with a laser beam according to image data.

A transfer device 3 is disposed above the image forming devices 4Y, 4C, 4M, and 4K. The transfer device 3 includes the intermediate transfer belt 30 as a transfer body, four primary transfer rollers 31 as primary transfer devices, and a secondary transfer roller 36 as a secondary transfer device. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. In the present embodiment, as a driver drives and rotates the secondary transfer backup roller 32 counterclockwise, the intermediate transfer belt 30 rotates in a direction indicated by arrow in FIG. 1.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply situated inside the image forming apparatus 1. The power supply applies a predetermined direct current (DC) voltage and/or a predetermined alternating current (AC) voltage to each of the primary transfer rollers 31.

The intermediate transfer belt 30 is interposed between the secondary transfer roller 36 and the secondary transfer backup roller 32 to form a secondary transfer nip. Similar to the primary transfer rollers 31, the secondary transfer roller 36 is coupled to the power supply situated inside the image forming apparatus 1. The power supply applies at least one of a predetermined direct current (DC) voltage and a predetermined alternating current (AC) voltage to the secondary transfer roller 36.

The belt cleaner 35 includes a cleaning brush and a cleaning blade that contact an outer circumferential surface of the intermediate transfer belt 30. A bottle holder 2 disposed in an upper portion of the image forming apparatus 1 accommodates four toner bottles 2Y, 2C, 2M, and 2K detachably attached to the bottle holder 2. The toner bottles 2Y, 2C, 2M, and 2K contain fresh yellow, cyan, magenta, and black toners to be supplied to the developing devices 7 of the image forming devices 4Y, 4C, 4M, and 4K, respectively. Toner supply tubes are interposed between the toner bottles 2Y, 2C, 2M, and 2K and the respective developing devices 7. The fresh toner is supplied from the toner bottles 2Y, 2C, 2M, and 2K to the respective developing devices 7 through the toner supply tubes.

In a lower portion of the image forming apparatus 1, the image forming apparatus includes a sheet feeding tray 10 that loads a plurality of sheets P as recording media and a feed roller 11 that picks up and feeds a sheet P from the sheet feeding tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, the image forming apparatus 1 may include a bypass feeder that imports such recording media placed on a bypass tray into the housing of the image forming apparatus 1.

The image forming apparatus 1 includes a conveyance path R to convey the sheet P from the sheet feeding tray 10 to a sheet ejection roller pair 13 via the secondary transfer nip. The sheet ejection roller pair 13 ejects the sheet P outside the housing of the image forming apparatus 1. On the conveyance path R, a pair of registration rollers 12 as a conveyance device to convey the sheet P to the secondary transfer nip is disposed upstream from the secondary transfer roller 36 in a sheet conveyance direction.

The fixing device 20 is disposed downstream from the secondary transfer roller 36 in the sheet conveyance direction. The fixing device 20 receives the sheet P bearing a toner image and fixes the toner image onto the sheet P. The sheet ejection roller pair 13 is disposed downstream from the fixing device 20 in the sheet conveyance direction. On the conveyance path R downstream from the fixing device 20 in the sheet conveyance direction, the sheet ejection roller pair 13 is disposed to eject the sheet P outside the image forming apparatus 1. To stack the sheet P ejected outside the image forming apparatus 1, an output tray 14 is disposed on a top surface of the image forming apparatus 1.

When the image forming apparatus 1 starts the image forming operation, the photoconductor 5 in each of the image forming devices 4Y, 4M, 4C, and 4K is driven to rotate clockwise in FIG. 1, and the charger 6 uniformly charges the surface of the photoconductor 5 in a predetermined polarity. The exposure device 9 emits laser beams onto the charged outer circumferential surfaces of the respective photoconductors 5, respectively, thus forming electrostatic latent images on the photoconductors 5. The image data used to expose the respective photoconductors 5 is monochrome image data produced by decomposing a desired full color image into yellow, cyan, magenta, and black image data. The developing devices 7 supply yellow, cyan, magenta, and black toners to the electrostatic latent images formed on the photoconductors 5, visualizing the electrostatic latent images as yellow, cyan, magenta, and black toner images, respectively.

Simultaneously, as the image forming operation starts, the secondary transfer backup roller 32 is driven and rotated counterclockwise in FIG. 1, rotating the intermediate transfer belt 30 in a rotation direction illustrated in FIG. 1 by friction therebetween. The power supply applies a constant voltage or a constant current control voltage having a polarity opposite a polarity of the charged toner to the primary transfer rollers 31, creating a transfer electric field at each of the primary transfer nips formed between the photoconductors 5 and the primary transfer rollers 31, respectively.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a full color toner image is formed on the outer circumferential surface of the intermediate transfer belt 30. After the primary transfer of the yellow, cyan, magenta, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed the sheet P from the sheet feeding tray 10 toward the pair of registration rollers 12 through the conveyance path R. The pair of registration rollers 12 conveys the sheet P sent to the conveyance path R by the feed roller 11 to the secondary transfer nip formed between the secondary transfer roller 36 and the intermediate transfer belt 30 supported by the secondary transfer backup roller 32 at a proper time. At this time, the secondary transfer roller 36 is applied a transfer voltage of the polarity opposite the charged polarity of toner of the toner image on the intermediate transfer belt 30 to form a transfer electric field at the secondary transfer nip.

As the yellow, cyan, magenta, and black toner images constructing the full color toner image on the intermediate transfer belt 30 reach the secondary transfer nip in accordance with rotation of the intermediate transfer belt 30, the transfer electric field created at the secondary transfer nip secondarily transfers the yellow, cyan, magenta, and black toner images from the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into a waste toner container disposed inside the image forming apparatus 1.

Thereafter, the sheet P bearing the full color toner image is conveyed to the fixing device 20 that fixes the full color toner image on the sheet P. The sheet P bearing the fixed full color toner image is ejected by the sheet ejection roller pair 13 onto the outside of the image forming apparatus 1, that is, the output tray 14 that stocks the sheet P.

The foregoing description pertains to the image forming operation of the image forming apparatus 1 to form the full color toner image on the sheet P. Alternatively, the image forming apparatus 1 may form a monochrome toner image by using any one of the four image forming devices 4Y, 4C, 4M, and 4K or may form a bicolor toner image or a tricolor toner image by using two or three of the image forming devices 4Y, 4C, 4M, and 4K.

Next, a description is given of the fixing device 20 according to the present embodiment of the present disclosure. Although the heating device according to the present disclosure is used as the fixing device 20 in the present embodiment, the heating device according to the present disclosure is not limited to this. The heating device according to the present disclosure may be used as a commonly used and known heating device such as a laminator.

Figure 2:
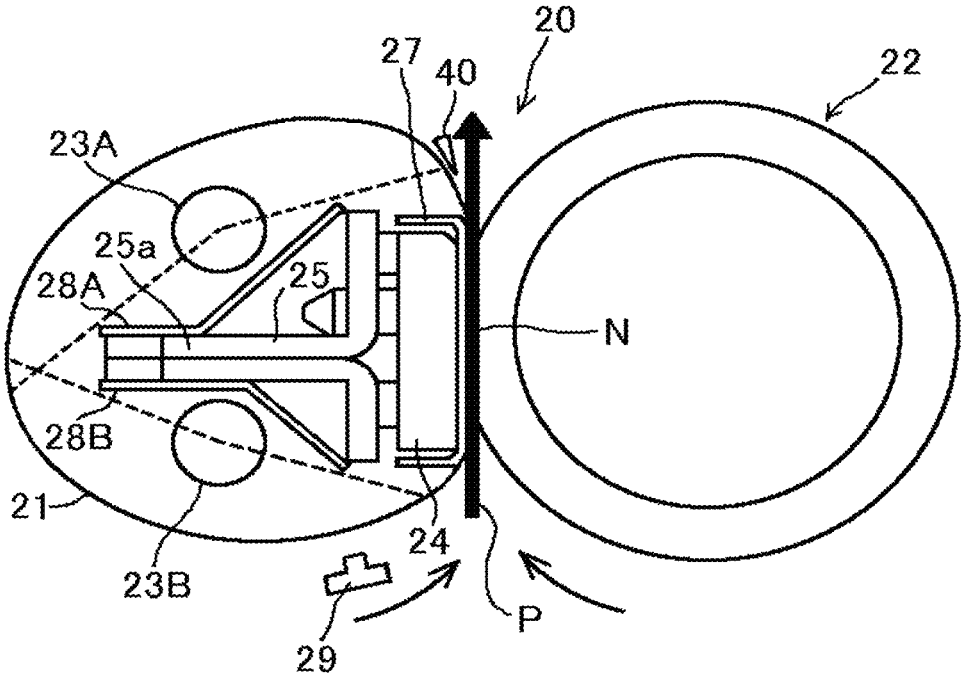
FIG. 2 is a schematic cross-sectional view of a fixing device incorporated in the image forming apparatus of FIG. 1.

FIG. 2 is a schematic cross-sectional view of the fixing device 20 according to the present embodiment.

The fixing device 20 includes an endless fixing belt 21 that is a thin and flexible tubular fixing rotator and a pressure roller 22 that is a pressing member that comes into contact with an outer circumferential surface of the fixing belt 21. The fixing belt 21 is heated by radiant heat radiated from a plurality of heaters 23A and 23B as fixing heat sources disposed inside the loop of the fixing belt 21. In the present embodiment, the heaters 23A and 23B are halogen heaters. Alternatively, the heaters 23A and 23B may be induction heaters, resistive heat generators, carbon heaters, or the like.

Note that the fixing belt 21 is an example of a first rotator of the heating device, and the pressure roller 22 is an example of a second rotator of the heating device.

Additionally, inside the loop of the fixing belt 21, the fixing device 20 includes a nip formation pad 24 to form a fixing nip N between the pressure roller 22 and the fixing belt 21 and a stay 25 that is a support to support the nip formation pad 24. The stay 25 secures and supports the nip formation pad 24 extending in a width direction of the fixing belt 21 that is also an axial direction of the fixing belt 21. Accordingly, even if the nip formation pad 24 is pressed by the pressure roller 22, the stay 25 prevents the nip formation pad 24 from being bent by the pressure of the pressure roller 22 and therefore allows the nip formation pad 24 to maintain a uniform nip length of the fixing nip N over the entire width of the pressure roller 22 in an axial direction or a longitudinal direction of the pressure roller 22.

The nip formation pad 24 is made of a heat-resistant material having good mechanical strength and heat-resistant up to about 200° C. More specifically, the nip formation pad 24 is made of a heat-resistant resin such as polyimide (PI) resin, polyether ether ketone (PEEK) resin, or one of those resins reinforced with glass fibers. Thus, the nip formation pad 24 is immune from thermal deformation at temperatures in a fixing temperature range desirable to fix the toner image on the sheet P, thereby retaining the shape of the fixing nip N and quality of the toner image formed on the sheet P. Both lateral ends of the stay 25 and the heaters 23A and 23B in the longitudinal direction thereof are secured to and supported by a pair of side plates of the fixing device 20 or a pair of holders.

The thermal equalizer 27, which is also called a thermal conduction aid, easily transfers heat in the longitudinal direction of the fixing belt 21 and is disposed to cover a surface of the nip formation pad 24 facing an inner circumferential surface of the fixing belt 21. The thermal equalizer 27 transports and equalizes heat in a longitudinal direction of the thermal equalizer 27 that is parallel to the axial direction of the fixing belt 21, preventing heat from being stored at both lateral ends of the fixing belt 21 in the axial direction thereof when the fixing device 20 fixes images on a plurality of small sheets P. Thus, the thermal equalizer 27 eliminates uneven temperature of the fixing belt 21 in the axial direction thereof. Therefore, the thermal equalizer 27 is made of a material that conducts heat quickly, for example, a material having an enhanced thermal conductivity such as copper and aluminum.

As illustrated in FIG. 2, a surface of the thermal equalizer 27 facing an inner circumferential surface of the fixing belt 21 directly contacts the fixing belt 21, forms a nip formation surface, and is planar, but alternatively may be recessed or have other shapes. For example, a recessed nip formation surface directs a leading edge of the sheet P toward the pressure roller 22 as the sheet P is ejected from the fixing nip N, thereby facilitating separation of the sheet P from the fixing belt 21 and preventing a sheet jam.

A lubricant such as fluorine oil or fluorine grease that contain a fluorine compound is applied to the inner circumferential surface of the fixing belt 21 to reduce friction between the thermal equalizer 27 and the fixing belt 21. The lubricant is fluorine grease or silicone grease containing fluorine particles as a thickener.

A temperature sensor 29 is disposed opposite the outer circumferential surface of the fixing belt 21 at a proper position thereon, for example, a position upstream from the fixing nip N in a rotation direction of the fixing belt 21. The temperature sensor 29 detects a temperature of the fixing belt 21. In the fixing device 20, a separator 40 is disposed downstream from the fixing nip N in the sheet conveyance direction to separate the sheet P from the fixing belt 21. A pressing assembly presses the pressure roller 22 against the nip formation pad 24 via the fixing belt 21 and releases pressure exerted by the pressure roller 22 to the fixing belt 21.

To reduce the thermal capacity of the fixing belt 21, the fixing belt 21 has a thin film-like endless form and a downsized loop diameter and includes a base layer that forms the inner circumferential surface of the fixing belt 21 and a release layer that forms the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer. While the fixing belt 21 and the pressure roller 22 pressingly sandwich the unfixed toner image on the sheet P to fix the toner image on the sheet P, the elastic layer having a thickness of about 100 μm elastically deforms to absorb slight surface asperities of the fixing belt 21, preventing variation in gloss of the toner image on the sheet P.

In order to decrease the thermal capacity of the fixing belt 21, the fixing belt 21 has a total thickness not greater than 1 mm and a loop diameter in a range of from 20 mm to 40 mm. For example, the base layer of the fixing belt 21 has a thickness in a range of from 20 μm to 50 μm. The elastic layer of the fixing belt 21 has a thickness in a range of from 100 μm to 300 μm. The release layer of the fixing belt 21 has a thickness in a range of from 10 μm to 50 μm. In order to further reduce thermal capacity, preferably, the fixing belt 21 may have a total thickness not greater than 0.2 mm, and more preferably, not greater than 0.16 mm, and a loop diameter of the fixing belt 21 is preferably equal to or smaller than 30 mm.

The stay 25, having a T-shape in cross-section, includes an arm 25*a* extending in a direction perpendicular to the fixing nip N. The arm 25*a* is interposed between the heaters 23A and 23B as fixing heaters to screen the heater 23A from the heater 23B. One of the heaters 23A and 23B includes a center heat generation area spanning a center of the one of the heaters 23A and 23B in the longitudinal direction thereof to heat toner images on small sheets P passing through the fixing nip N. The other one of the heaters 23A and 23B includes a lateral end heat generation area spanning each end portion of the other one of the heaters 23A and 23B in the longitudinal direction thereof to heat toner images on large sheets P passing through the fixing nip N.

The power supply situated inside the image forming apparatus 1 supplies power to the heaters 23A and 23B so that the heaters 23A and 23B generate heat. A controller operatively connected to the heaters 23A and 23B and the temperature sensor 29 controls the heaters 23A and 23B based on the temperature of the outer circumferential surface of the fixing belt 21, which is detected by the temperature sensor 29 disposed opposite the outer circumferential surface of the fixing belt 21. Such heating control of the heaters 23A and 23B adjusts the temperature of the fixing belt 21 to a desired fixing temperature.

The reflectors 28A and 28B are interposed between the stay 25 and the heaters 23A and 23B, respectively, to reflect light radiated from the heaters 23A and 23B toward the fixing belt 21, thereby enhancing heating efficiency of the heaters 23A and 23B to heat the fixing belt 21. The reflectors 28A and 28B prevent light and heat radiated from the heaters 23A and 23B from heating the stay 25, suppressing waste of energy. Alternatively, instead of the reflectors 28A and 28B, a heater-side face of the stay 25 disposed opposite the heaters 23A and 23B may be insulated or given a mirror finish to reflect light and heat radiated from the heaters 23A and 23B toward the fixing belt 21.

The pressure roller 22 includes a core bar; an elastic layer coating the core bar and being made of silicone rubber foam, fluoro rubber, or the like; and a release layer coating the elastic layer and being made of PFA, PTFE, or the like. The pressing assembly including a spring presses the pressure roller 22 against the fixing belt 21 to form the fixing nip N. The pressure roller 22 pressingly contacting the fixing belt 21 deforms the elastic layer of the pressure roller 22 at the fixing nip N formed between the pressure roller 22 and the fixing belt 21, thus defining the fixing nip N having a predetermined length in the sheet conveyance direction.

A driver such as a motor disposed inside the image forming apparatus 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the fixing belt 21 and the pressure roller 22. When the fixing belt 21 rotates, the fixing belt 21 is sandwiched between the pressure roller 22 and the nip formation pad 24 at the fixing nip N and, at a circumferential span of the fixing belt 21 other than the fixing nip N, is guided by flanges 45 on side plates disposed at both ends of the fixing device 20.

According to the present embodiment, the pressure roller 22 is a solid roller. Alternatively, the pressure roller 22 may be a hollow roller. In this case, a heater such as a halogen heater may be disposed inside the hollow roller. The elastic layer of the pressure roller 22 may be made of solid rubber. Alternatively, if no heater is situated inside the pressure roller 22, the elastic layer of the pressure roller 22 may be made of sponge rubber. The sponge rubber is preferable to the solid rubber because the sponge rubber has enhanced thermal insulation that draws less heat from the fixing belt 21.

Figure 3:
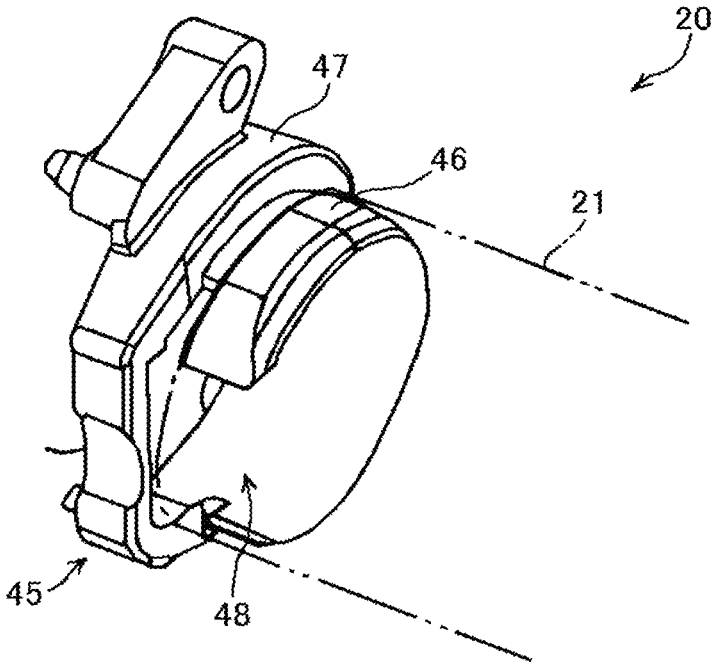
FIG. 3 is a schematic perspective view of a lateral end of the fixing device of FIG. 2.

FIG. 3 is a schematic perspective view illustrating a lateral end of the fixing device 20. The flange 45 is disposed at each lateral end of the fixing belt 21 in the axial direction thereof. FIG. 3 illustrates the flange 45 disposed at one lateral end of the fixing belt 21 in the axial direction thereof.

The flange 45 is hollow and open at both lateral ends in an axial direction thereof parallel to the axial direction of the fixing belt 21. The flange 45 includes a receiver 46 extending in the axial direction of the fixing belt 21 and a flange portion 47 projecting in a radial direction of the flange 45 from the receiver 46 and being molded with the receiver 46. The receiver 46 includes a slit 48 at a part of the receiver 46 in a circumferential direction of the fixing belt 21 and is partially cylindrical or tubular. The nip formation pad 24 and the thermal equalizer 27 are inserted into a space defined by the slit 48.

If the fixing belt 21 is skewed in the axial direction of the fixing belt 21, a lateral end of the fixing belt 21 in the axial direction thereof comes into contact with the receiver 46 that restricts motion of the fixing belt 21 in the axial direction thereof. The flange portion 47 is secured to the side plate of the fixing device 20. Optionally, a plate ring may be interposed between the receiver 46 and each lateral end of the fixing belt 21 in the axial direction thereof. The plate ring is made of a material that facilitates sliding of the fixing belt 21 over the plate ring.

Figure 4:
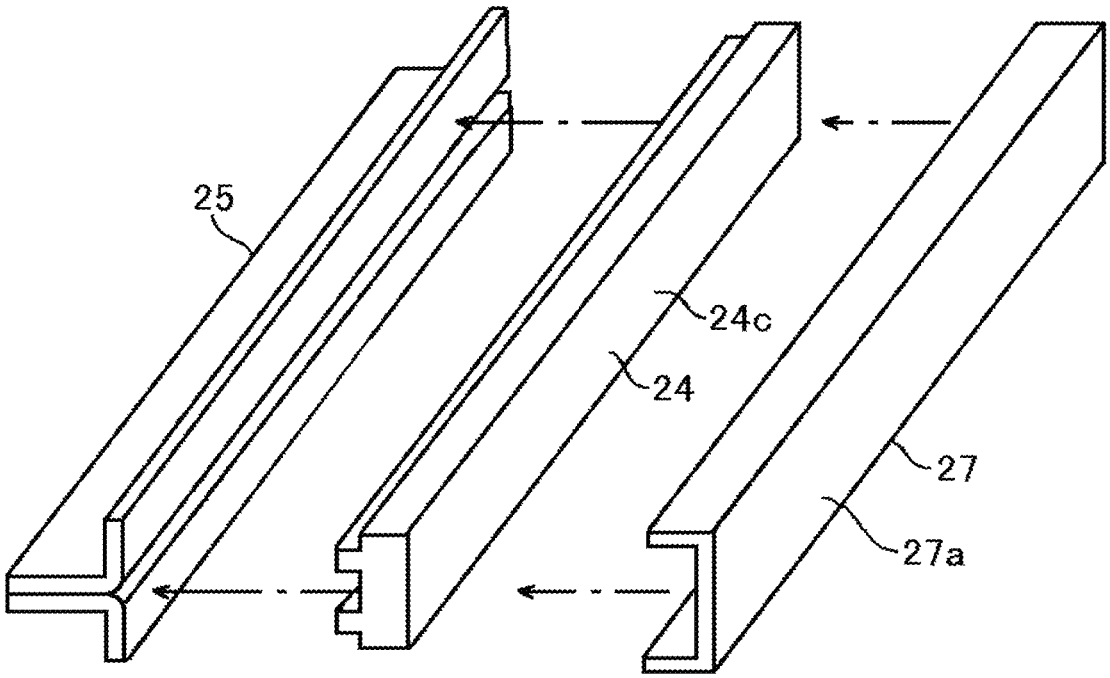
FIG. 4 is an exploded perspective view illustrating a support, a nip formation pad, and a thermal equalizer, which constitute a nip formation unit.

FIG. 4 is an exploded perspective view illustrating the support 25, the nip formation pad 24, and the thermal equalizer 27, which constitute a nip formation unit.

As illustrated in FIG. 4, the thermal equalizer 27 is fitted on the nip formation pad 24 having an approximately rectangular shape to cover a surface of the nip formation pad 24 facing the inner circumferential surface of the fixing belt 21, and the thermal equalizer 27 and the nip formation pad 24 form one unit. The thermal equalizer 27 may be coupled with the nip formation pad 24 with a claw, an adhesive, or the like.

The thermal equalizer 27 includes a belt-side face 27*a* that is disposed opposite the inner circumferential surface of the fixing belt 21. The nip formation pad 24 includes a nip-side face 24*c* facing the fixing nip N and a stay-side face that is opposite the nip-side face 24*c* and supported by a nip-side face of the stay 25. Preferably, the stay-side face of the nip formation pad 24 and the nip-side face of the stay 25 may include a recess and a projection (e.g., a boss and a pin), respectively, to reduce a contact area between the nip formation pad 24 and the stay 25.

A description is provided of an advantageous configuration of the fixing device 20.

A first embodiment is described below.

Figure 5:
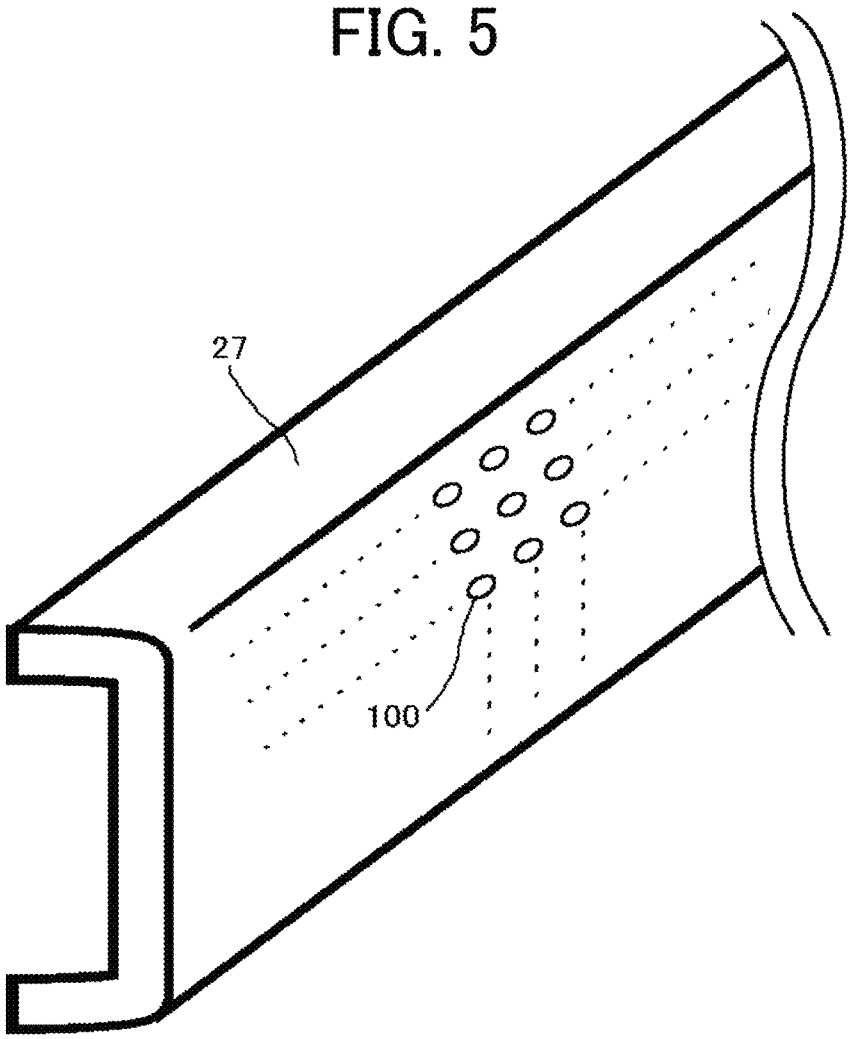
FIG. 5 is a perspective view illustrating the thermal equalizer according to a first embodiment of the present disclosure.

FIG. 5 is a perspective view illustrating the thermal equalizer 27 according to the first embodiment of the present disclosure. As illustrated in FIG. 5, a plurality of concave portions 100 that are dimples are formed on the surface of the thermal equalizer 27, that is, the surface of the thermal equalizer 27 facing the inner circumferential surface of the fixing belt 21. The plurality of concave portions 100 may be formed by, for example, cutting, pressing, laser processing, etching, blasting, and other methods.

The plurality of concave portions 100 are intended to circulate the lubricant disposed between the thermal equalizer 27 and the fixing belt 21 and to form an oil film on a surface on the thermal equalizer on which the fixing belt 21 slides. Therefore, the plurality of concave portions 100 have the following features.

Figure 6A:
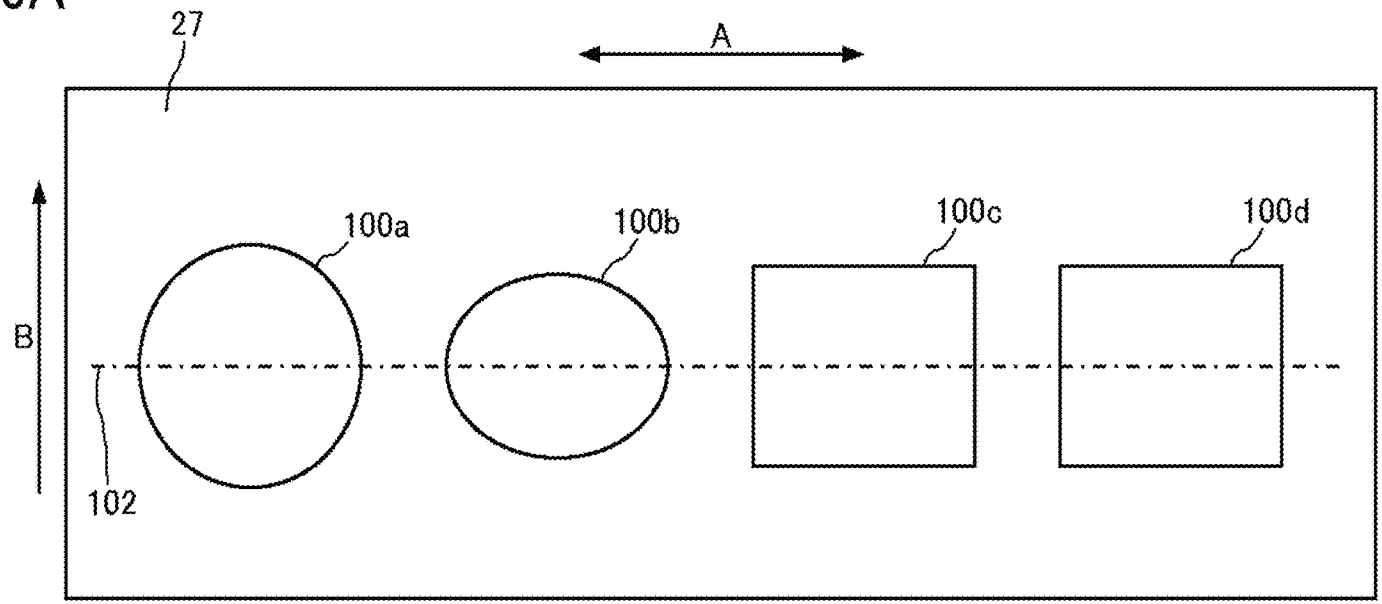
FIG. 6A is a plan view illustrating specific examples of shapes of concave portions that are dimples formed on the thermal equalizer.
Figure 6B:
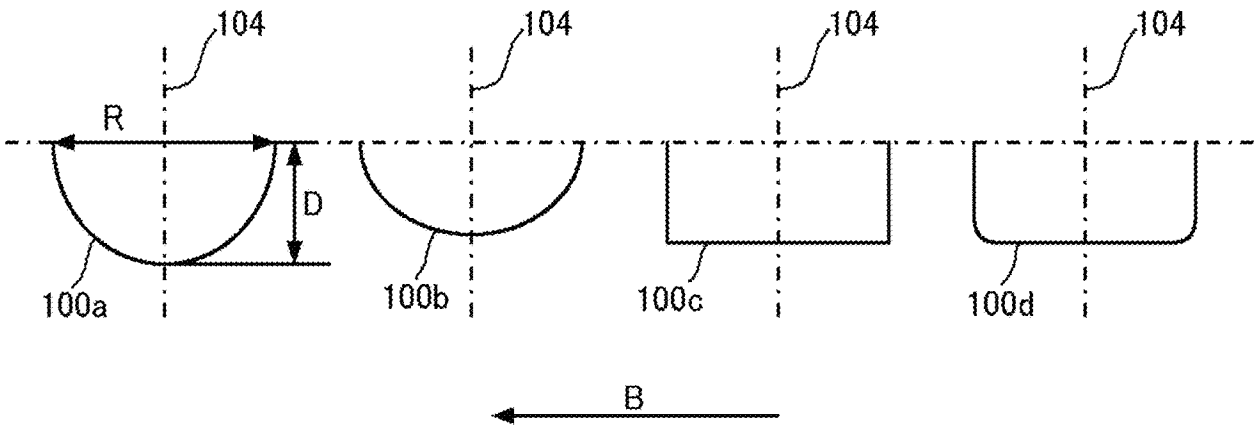
FIG. 6B is a cross-sectional view of the concave portions that are dimples formed on the thermal equalizer viewed from the direction of arrow A in FIG. 6A.

FIG. 6A is a plan view illustrating specific examples of shapes of concave portions 100*a* to 100*d* that are dimples formed on the thermal equalizer 27. FIG. 6B is a cross-sectional view of the concave portions as viewed from a direction of an arrow A in FIG. 6A. In FIGS. 6A and 6B, the arrow A indicates the longitudinal direction of the thermal equalizer 27, and an arrow B indicates a direction of movement of the fixing belt 21. The direction of movement of the fixing belt 21 is orthogonal to the longitudinal direction of the thermal equalizer 27.

The concave portions 100 that are dimples in the present embodiment are substantially line-symmetric with respect to a first center line 102 of each concave portion 100 parallel to the arrow A in the plan view of the thermal equalizer 27, which are illustrated as the concave portions 100*a* to 100*d* in FIG. 6A. Additionally, as illustrated in FIG. 6B, each of the concave portions 100 is substantially line-symmetric with respect to a second center line 104 in a cross section of each of the concave portions 100*a* to 100*d* viewed from a direction perpendicular to the direction of movement of the fixing belt 21 that is a short-side direction of the thermal equalizer 27.

The above-described "substantially line-symmetric" does not mean an accurate line symmetry in the definition of mathematics. The above-described "substantially line-symmetric" includes a shape including differences from the accurate line-symmetric shape due to dimensional tolerances and/or errors when the concave portions that are dimples are formed.

FIG. 6B illustrates an example of dimensions of the concave portion 100*a*. The diameter R of the concave portion 100*a* is approximately 200 μm to 1000 μm, and the depth D of the concave portion 100*a* is approximately 5 μm to 30 μm. Alternatively, like the concave portions 100*c* or 100*d* in FIG. 6B, the corners may be cut to be processed into a shape such as a square surface or a round surface.

In the fixing device 20 including the thermal equalizer 27 configured as described above, a typical operation of the fixing belt 21, that is, moving the fixing belt 21 in the direction of arrow B similarly moves the lubricant in the direction of arrow B. In the movement of the lubricant, the plurality of concave portions 100 that are dimples formed on the thermal equalizer 27 have inlets and outlets having the substantially same shape which the lubricant enters and exits. Therefore, the lubricant easily enters and exits into the concave portions 100, and the concave portions are filled with a certain amount of the lubricant, which enables the lubricant to supply the nip between the thermal equalizer 27 and the inner circumferential surface of the fixing belt 21.

In addition, reverse rotations of the fixing belt 21 caused by the sheet jam, that is, a movement of the fixing belt 21 in a direction opposite to the direction of arrow B can also supply the lubricant to the nip as in the typical operation.

The metallic thermal equalizer 27 having the plurality of concave portions 100 that are dimples is less likely to wear than a coating layer processed to have a surface roughness to hold the lubricant. Therefore, the fixing device 20 of the present embodiment can hold and supply the lubricant in the nip over time and maintain the sliding performance over time.

A description is provided of variation of the thermal equalizer 27.

The surface of the thermal equalizer 27 in the present embodiment may be coated with solid lubricant such as fluorine compound or graphite to improve sliding performance, which is called a slide coating. The plurality of concave portions 100 formed on the surface of the thermal equalizer 27 does not request the slide coating adjusting the surface roughness to hold the lubricant. Therefore, forming the plurality of concave portions 100 eliminates advanced production management of the slide coating and further improves the sliding performance at low cost.

Next, a second embodiment is described.

In the first embodiment, the plurality of concave portions 100 that are dimples having designed shapes are formed on the thermal equalizer 27. In the second embodiment, the plurality of concave portions 100 that are dimples are formed and arranged in a plurality of rows 105 extending at an angle with respect to the direction of movement of the fixing belt 21.

Figure 7A:
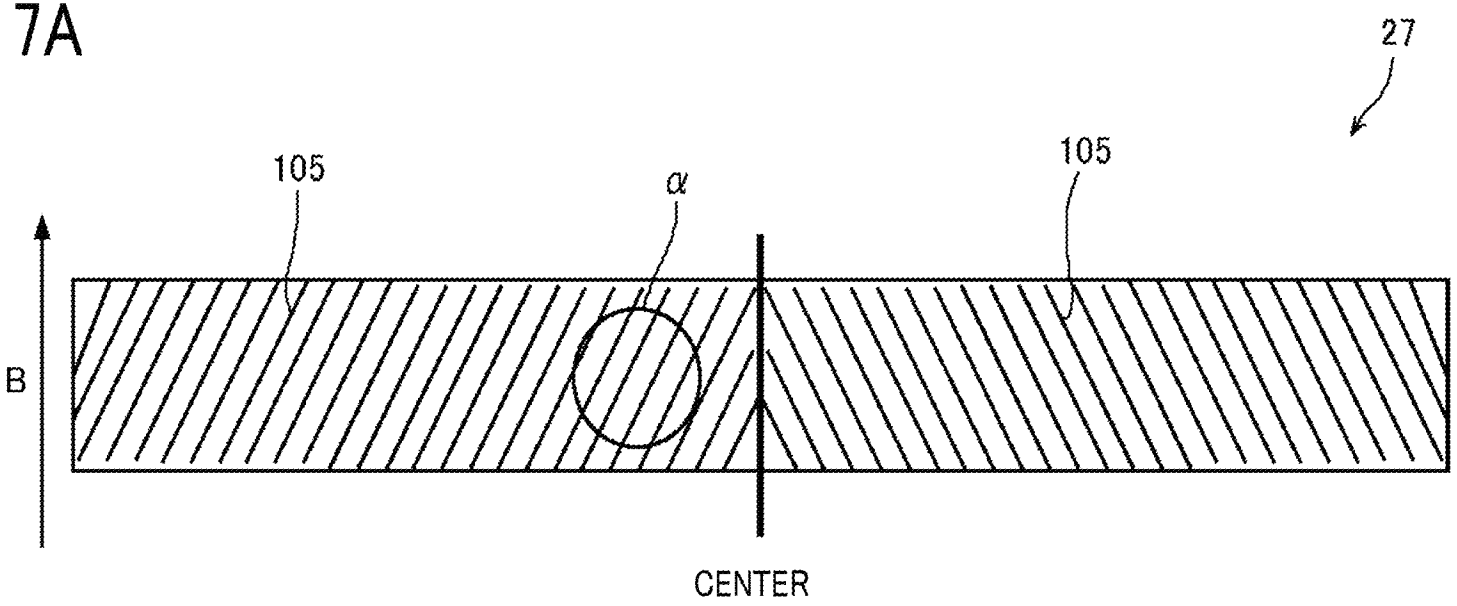
FIG. 7A is a schematic plan view illustrating the thermal equalizer of a second embodiment.
Figure 7B:
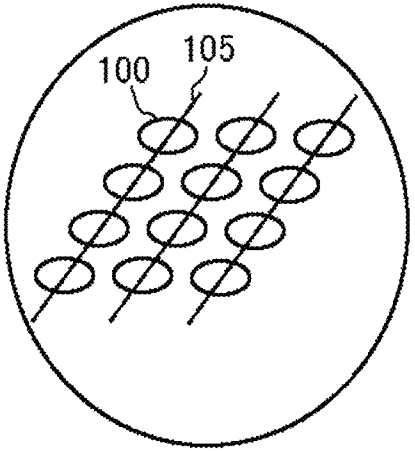
FIG. 7B is a partially enlarged view illustrating a configuration of a portion indicated by a reference character a in FIG. 7A.
Figure 8:
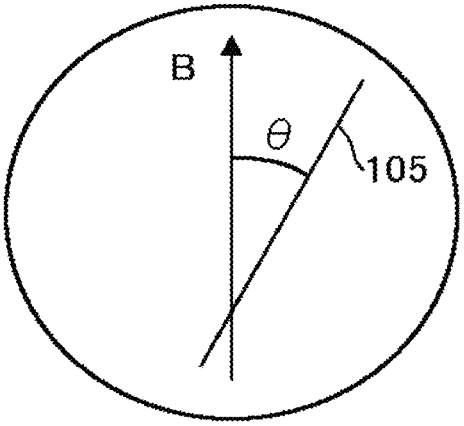
FIG. 8 is an explanatory diagram illustrating an angle θ between a direction of movement of a fixing belt and a row of the concave portions.

FIG. 7A is a schematic plan view illustrating the thermal equalizer 27 of a second embodiment. FIG. 7B is a partially enlarged view illustrating a configuration of a portion indicated by a in FIG. 7A. FIG. 8 is an explanatory diagram illustrating an angle θ between a direction of movement of a fixing belt and a row of the concave portions.

As illustrated in FIG. 7, the plurality of concave portions 100 are formed in a plurality of rows 105 on the thermal equalizer 27, respectively. The plurality of rows 105 are inclined in a direction toward the center of the thermal equalizer 27 as the fixing belt 21 advances in the direction of movement of the fixing belt 21, that is, the direction of arrow B. The inclined angle θ is an angle of 0 degrees or more and less than 90 degrees with respect to the direction of movement of the fixing belt 21 and is preferably an angle of 0 degrees or more and less than 45 degrees (see FIG. 8).

Since the plurality of concave portions 100 that are dimples are arranged in the rows as described above, the typical operation of the fixing belt 21, that is, the movement of the fixing belt 21 in the direction of arrow B circulates and moves the lubricant toward the center of the thermal equalizer 27. Moving the lubricant toward the center of the thermal equalizer 27 prevents the lubricant from leaking from the end of the fixing belt 21 that forms an opening, which forms a stable oil film over a long period of time.

In the reverse rotations of the fixing belt 21 caused by the sheet jam, that is, the movement of the fixing belt 21 in the direction opposite to the direction of arrow B, the rows of the plurality of concave portions 100 arranged as described above moves the lubricant in reverse, that is, toward the end of the fixing belt 21. However, since the reverse rotations complete in much shorter time than the typical operation, suitably designed shapes of the inlets and outlets of the concave portions enables the above-described influence of the arrangement to be negligible.

In addition, for example, near the end of the thermal equalizer 27, the angles of the plurality of rows 105 may be set approximately 0 degrees with respect to the direction of movement of the fixing belt 21 and gradually increased to near 45 degrees with respect to the direction of movement of the fixing belt 21 as the concave portions 100 approach the center of the thermal equalizer 27. As described above, increasing the angle θ toward the center of the thermal equalizer 27 (or decreasing the angle θ toward the both ends of the thermal equalizer 27) can further reliably prevent the leakage of the lubricant from the end of the fixing belt 21 that forms the opening.

A third embodiment is described below.

In the first embodiment, the concave portion 100 that is the dimple has a substantially line-symmetric shape with respect to the first center line 102 parallel to the arrow A in the plan view of the thermal equalizer 27. In contrast, in the third embodiment, the plurality of concave portions that are dimples each have a shape rotated at an arbitrary angle with respect to the center line 102 on the surface of the thermal equalizer 27.

Figure 9A:
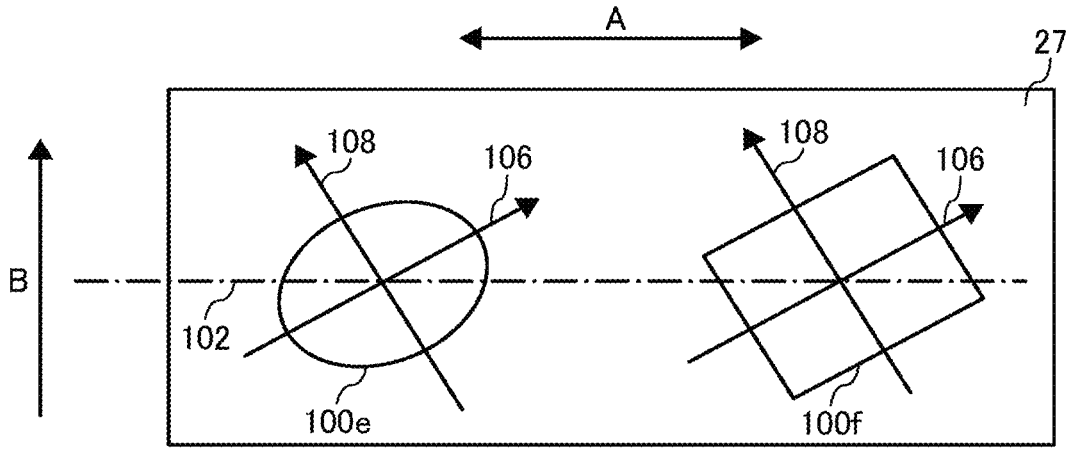
FIG. 9A is a plan view illustrating specific examples of shapes of concave portions that are dimples according to a third embodiment.
Figure 9B:
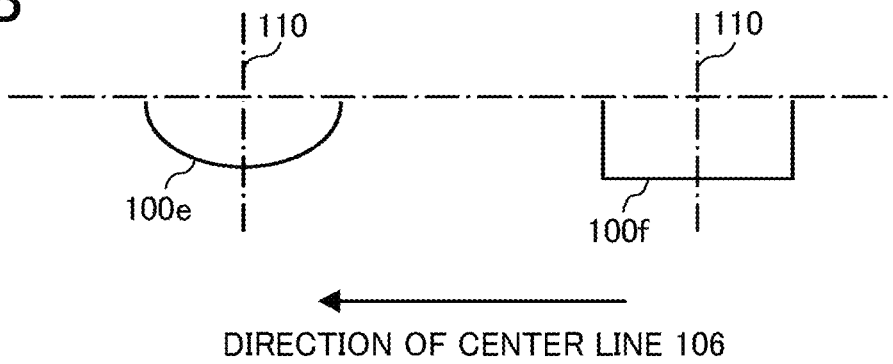
FIGS. 9B and 9C are cross-sectional views of the concave portions as viewed from two directions.
Figure 9C:
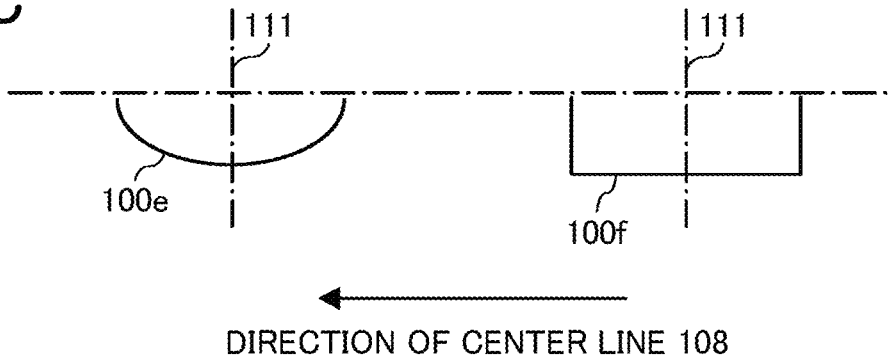

FIG. 9A is a plan view illustrating specific examples of shapes of concave portions that are dimples according to the third embodiment, and FIGS. 9B and 9C are cross-sectional views of the concave portions as viewed from two directions defined by center lines 106 and 108 in FIG. 9A, respectively. As illustrated in FIG. 9A, the concave portions **100*e* and 100*f* that are dimples are substantially line-symmetric with respect to the center lines 106 and 108 of each concave portion that are orthogonal to each other on the surface of the thermal equalizer 27. In addition, as illustrated in FIGS. 9B and 9C, the concave portions 100*e* and 100*f* are substantially line-symmetric with respect to the center lines 110 and 111 in cross-sections defined by the center lines 106 and 108** that are orthogonal to each other.

The above described shapes of the concave portions **100*e* and 100*f* that are dimples are not line-symmetric with respect to the first center line 102, but the volumes of the concave portions divided by the first center line 102 are substantially equal. Therefore, a lubricant volume flowing in the concave portions 100*e* and 100*f* are substantially equal to a lubricant volume flowing out of the concave portions 100*e* and 100*f*. Therefore, even if the fixing belt 21** performs the typical operation or the reverse rotations, the movement of the lubricant becomes substantially equal.

The concave portions **100*e* and 100*f* that are dimples in the third embodiment may be formed and arranged along the plurality of rows extending at the angle with respect to the direction of movement of the fixing belt 21** as in the second embodiment.

Using the above configuration can provide the fixing device (that is, the heating device) that can maintain the sliding performance of the thermal equalizer. In the image forming apparatus including the fixing device, the above-described configuration can prevent the fixing unit torque from increasing for a long time.

The embodiments of the present disclosure have been described in detail above. Numerous additional modifications to the above-described embodiment and variations are possible. It is therefore to be understood that, within the scope of the appended claims, the disclosure of this patent specification may be practiced otherwise than as specifically described herein. Therefore, the above-described first to third embodiments may be combined as appropriate. In the above embodiment, the nip formation pad 24 and the thermal equalizer 27 are separate members. Alternatively, one member may be designed to work as the thermal equalizer and the nip formation pad.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A heating device, comprising:

a first rotator forming a loop;

a heater configured to heat the first rotator;

a second rotator configured to contact an outer circumferential surface of the first rotator;

a nip formation pad disposed inside the loop of the first rotator to form a nip between the first rotator and the second rotator;

a thermal equalizer configured to cover a surface of the nip formation pad opposite the first rotator and transport heat in an axial direction of the first rotator, the thermal equalizer having a plurality of concave portions on a surface opposite the inner circumferential surface of the first rotator, each of the concave portions having a shape substantially symmetrical with respect to a first center line extending in a longitudinal direction of the thermal equalizer and with respect to a second center line in a cross section of the thermal equalizer, viewed from a direction perpendicular to a direction of movement of the first rotator; and a lubricant disposed between the thermal equalizer and the inner circumferential surface of the first rotator, wherein the plurality of concave portions is formed in a plurality of rows, each row being inclined inward, by an angle with respect to the direction of movement of the first rotator, toward a longitudinal center line of the thermal equalizer extending in the cross-section of the thermal equalizer, wherein the angle is more than 0 degrees and less than 90 degrees with respect to the direction of movement of the first rotator.

2. The heating device according to claim 1, wherein the angle is more than 0 degrees and less than 45 degrees with respect to the direction of movement of the first rotator.

3. The heating device according to claim 1, wherein a first angle of a first row near the longitudinal center line is larger than a second angle of a second row away from the longitudinal center line.

4. The heating device according to claim 1, wherein the surface of the thermal equalizer opposite the inner circumferential surface of the first rotator is coated with a friction-reducing coating.

5. A fixing device comprising the heating device according to claim 1, wherein the first rotator is a fixing belt, and the second rotator is a pressure rotator, wherein the heating device heats a recording medium passing through the nip to fix an unfixed image on the recording medium.

6. An image forming apparatus comprising the fixing device according to claim 5.

7. The heating device of claim 1, wherein each of the concave portions has curved sides.

8. A heating device, comprising:

a first rotator forming a loop;

a heater configured to heat the first rotator;

a second rotator configured to contact an outer circumferential surface of the first rotator;

a nip formation pad disposed inside the loop of the first rotator to form a nip between the first rotator and the second rotator;

a thermal equalizer configured to cover a surface of the nip formation pad opposite the first rotator and transport heat in an axial direction of the first rotator, the thermal equalizer having a plurality of concave portions on a surface opposite the inner circumferential surface of the first rotator, each concave portion of the concave portions having a shape substantially symmetrical with respect to two center lines orthogonal to each other on the surface of the thermal equalizer and center lines in cross sections of the concave portion viewed from directions of the two center lines; and a lubricant disposed between the thermal equalizer and the inner circumferential surface of the first rotator, wherein the plurality of concave portions is formed in a plurality of rows, each row being inclined inward, by an angle with respect to a direction of movement of the first rotator, toward a longitudinal center line of the thermal equalizer extending in a cross-section of the thermal equalizer, wherein the angle is more than 0 degrees and less than 90 degrees with respect to the direction of movement of the first rotator.

9. The heating device according to claim 8, wherein the angle is more than 0 degrees and less than 45 degrees with respect to the direction of movement of the first rotator.

10. The heating device according to claim 8, wherein a first angle of a first row near the longitudinal center line is larger than a second angle of a second row away from the longitudinal center line.

11. The heating device according to claim 8, wherein the surface of the thermal equalizer opposite the inner circumferential surface of the first rotator has a slide coating.

12. A fixing device comprising the heating device according to claim 8, wherein the first rotator is a fixing belt, and the second rotator is a pressure rotator, wherein the heating device heats a recording medium passes through the nip to fix an unfixed image on the recording medium.

13. An image forming apparatus comprising the fixing device according to claim 12.

* * * * *